United States Patent [19]

Takehara

[11] Patent Number: 4,520,738

[45] Date of Patent: Jun. 4, 1985

[54] DEVICE TO FORCE OUT INCINERATION ASH

[75] Inventor: Nobuo Takehara, Nishinomiya, Japan

[73] Assignee: Kabushiki Kaisha Takuma, Japan

[21] Appl. No.: 622,346

[22] Filed: Jun. 19, 1984

[51] Int. Cl.[3] ..... F23J 1/02

[52] U.S. Cl. ..... 110/171; 110/165 R; 110/259

[58] Field of Search ..... 110/165 R, 170, 169, 110/171, 259

[56] References Cited

U.S. PATENT DOCUMENTS

| | | | |
|---|---|---|---|
| 3,734,037 | 5/1973 | Martin | 110/165 R |
| 3,783,803 | 1/1974 | Martin et al. | 110/171 X |
| 4,048,928 | 9/1977 | Martin | 110/171 X |

*Primary Examiner*—Edward G. Favors

*Attorney, Agent, or Firm*—Griffin, Branigan & Butler

[57] ABSTRACT

A device to force out the incineration ash in which the main shaft that turns in the positive and inverse directions at a fixed angle by means of a driving mechanism is installed horizontally in the main body case provided with an ash receiving chamber in which water is filled for extinguishing of burning, an inlet opening for the incineration ash discharged out of a refuse incinerator and an outlet opening for the incineration ash after extinguishing of burning; and a pusher to force out the incineration ash settled down on the bottom of the ash receiving chamber and a pressing plate to force down matter floating on the water surface in the ash receiving chamber are fitted on the main shaft that turns in the positive and inverse directions at a fixed angle so as to move the pusher forwards and backwards and the pressing plate upwards and downwards.

8 Claims, 3 Drawing Figures

DEVICE TO FORCE OUT INCINERATION ASH

BACKGROUND OF THE INVENTION

The present invention relates to a device to force out the incineration ash which effects prompt and thorough extinguishing of burning of the incineration ash discharged out of a refuse incinerator for the purpose of incinerating city refuse, etc., and also enables smooth conveyance of the ash to the outside.

Conventionally, with a refuse incinerator, a device to discharge the incineration ash, with which the incineration ash discharged out of the incinerator falls in an ash receiving pit filled with water, and the incineration ash is settled on the conveyer equipped on the bottom of the pit, and the ash is then carried to the outside by the conveyer after the burning ash is extinguished; or a device to force out the incineration ash, with which the incineration ash discharged out of an incinerator falls in an ash receiving pit filled with water, and the incineration ash settled on the bottom of the pit is discharged to the outside by means of a pusher that reciprocates back and forth are commonly used.

However, with such conventional devices as aforementioned, when there exists nonburning properties in the incineration ash or such matter as metal cans are found in the incineration ash, they may remain floating on the water surface in the ash receiving chamber, thus resulting in a gradual formation of layers of the incineration ash that falls onto the floating matter, and in the end the entire water surface in the chamber is covered with such matter. This spread formation of layers of the incineration ash on the water surface is named "a bridge phenomenon". The occurance of the bridge phenomenon interferes with not only the smooth discharge of the incineration ash out of the refuse incinerator but also the extinguishing of burning of the discharged incineration ash, thus resulting in the operational failure of the refuse incinerator.

It is needless to say that an additional cost is required for the extra cleaning work to remove the floating matter once the aforementioned bridge phenomenon occurs. As explained above, there exist many technical difficulties with the aforementioned conventional devices to discharge the incineration ash either by using a conveyer or by a pusher reciprocating back and forth.

SUMMARY OF THE INVENTION

The present invention, therefore, contemplates the development of the improved device with the aforementioned backgrounds in mind.

It is the first object of the present invention to provide a device to force out the incineration ash with which the floating matter found on the water surface is forced to settle down on the bottom of the ash receiving chamber, thus preventing the occurance of a bridge phenomenon so that prompt and thorough extinguishing of burning of the incineration ash and also smooth discharge of the incineration ash are assured.

It is the second object of the present invention to provide a device to force out the incineration ash with which a single driving mechanism can be employed both for forcing the floating matter to settle down on the bottom of the ash receiving chamber and for discharging the ash settled down, thus allowing the reduction of the power cost and simplification of the structure of the device.

In accomplishing the aforementioned objectives, the device to force out the incineration ash in the present invention is so formed that the main shaft that turns in the positive and inverse directions at a fixed angle by means of a driving mechanism is installed horizontally in the main body case provided with an ash receiving chamber in which water is filled for the purpose of extinguishing of burning, an inlet opening for the incineration ash discharged out of a refuse incinerator and an outlet opening for the incineration ash after burning has been extinguished; a pusher to force out the incineration ash settled down on the bottom of the ash receiving chamber and a pressing plate to force down matter floating on the water surface in the ash receiving chamber are fitted on the main shaft that turns in the positive and inverse directions at a fixed angle so as to move the pusher forwards and backwards and the pressing plate upwards and downwards.

As aformentioned, the device to force out the incineration ash is so constructed that even when non-burning properties exist and/or matter such as metal cans are found floating on the water filled in the ash receiving chamber, they are forced down into the water by means of the pressing plate, thus prohibiting a bridge phenomenon. Stable operation of the device is thus ensured due to the smooth action of extinguishing burning and discharging the incineration ash.

In addition, due to the fact that the pressing plate and the pusher work alternately from a single main shaft, the operation and structure of the device to force out the incineration ash are so simplified that the manufacturing cost is thus remarkably reduced.

DETAILED DESCRIPTION OF THE INVENTION

Figure 1:
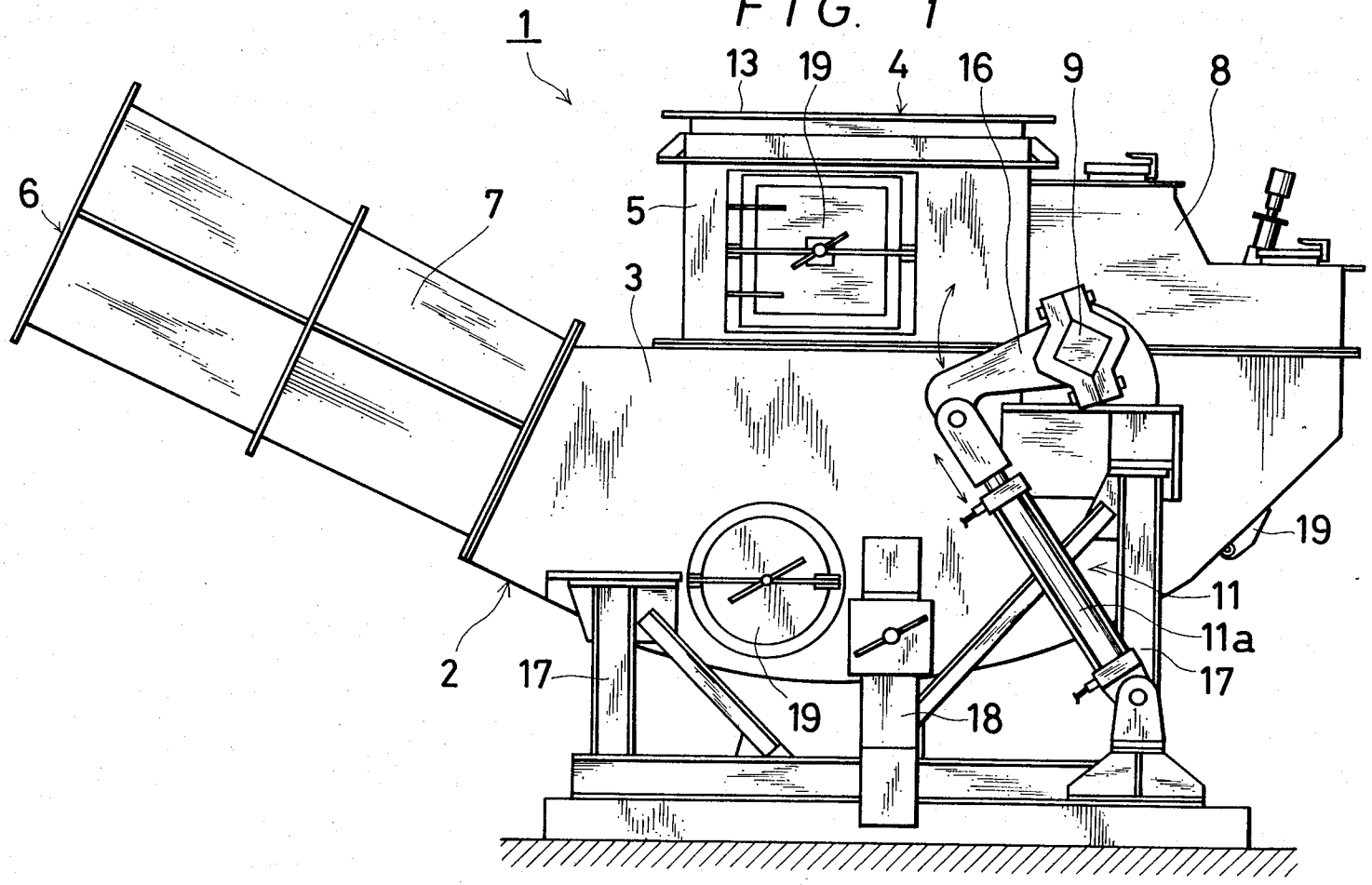
FIG. 1 is a side view of the device to extinguishing burning of the incineration ash and also to force out the incineration ash as one of the embodiments of the present invention.
Figure 2:
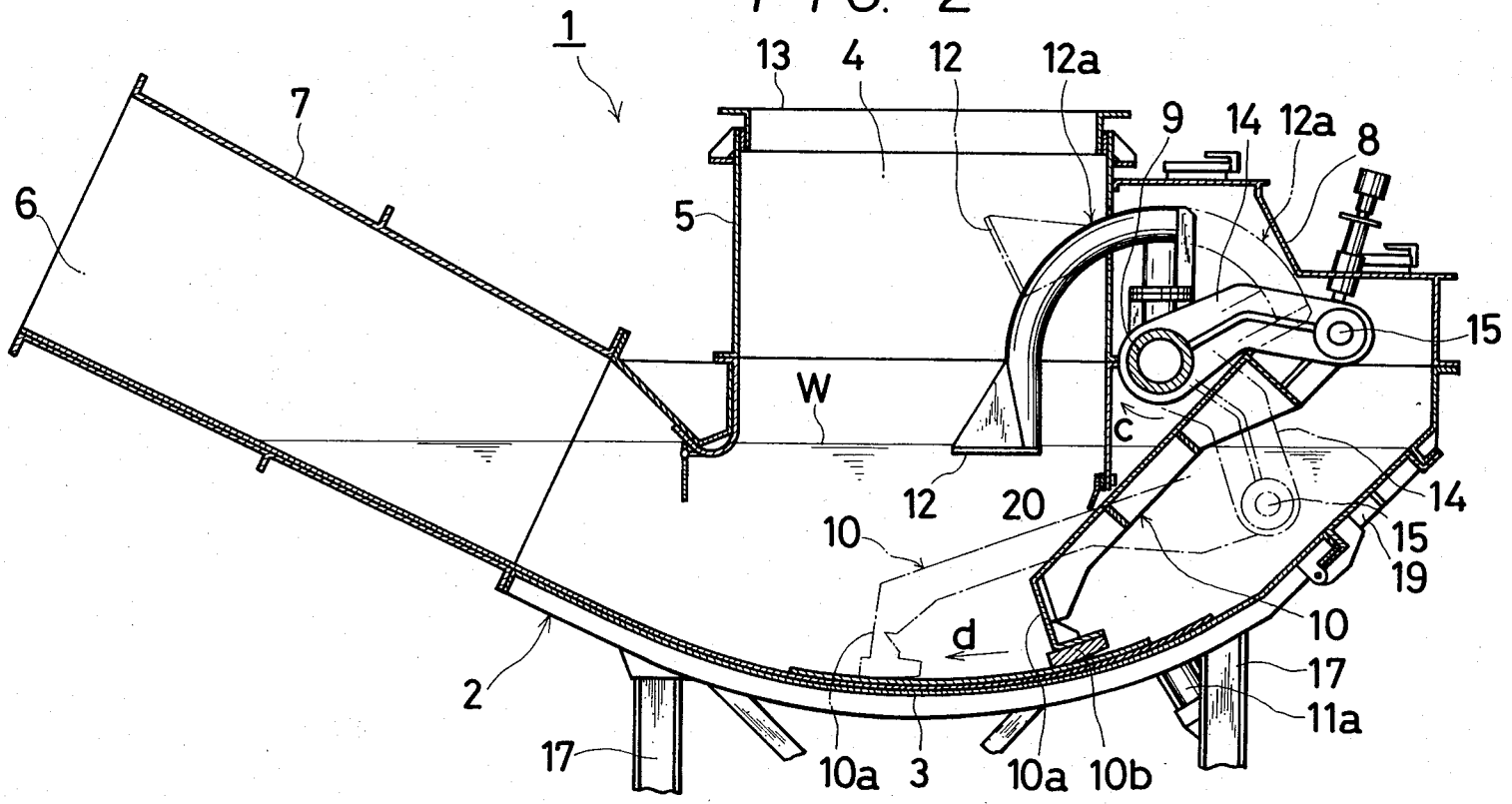
FIG. 2 is a cross-sectional side view of the device to extinguishing burning of the incineration ash and also to force out the incineration ash.
Figure 3:
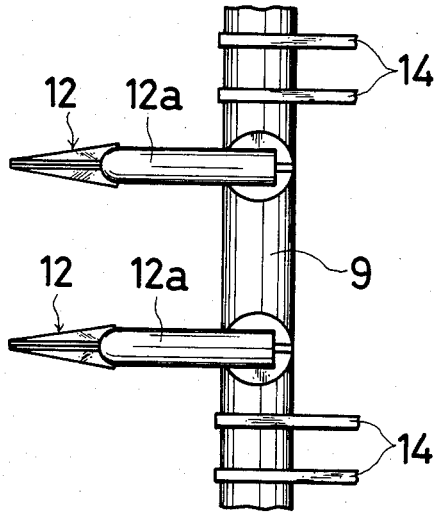
FIG. 3 is a plain view of the section of the main shaft illustrating how the lever for the pressing plate and a pusher are fitted to the main shaft.

Referring to one of the embodiments of the present invention shown in FIGS. 1, 2 and 3, the main part of the device to force out the incineration ash 1 related to the present invention comprises a main body case 2 equipped with an inlet opening placed above an ash receiving chamber 3 to receive high temperature incineration ash discharged out of a refuse incinerator (not illustrated) and an outlet opening 6 placed in the front part of the ash receiving chamber 3 to discharge the incineration ash after burning is extinguished; a main shaft 9 installed horizontally in the main body case 2; a pusher 10, which is connected to the main shaft 9 to force out the incineration ash settled down on the bottom of the ash receiving chamber 3 by means of the main shaft 9; a pressing plate 12, which is also connected to the main shaft 9 to force down matter floating on the surface of the water filled in the ash receiving chamber 3 by means of rotation of the main shaft; and a driving mechanism 11 that makes the aforementioned main shaft 9 turn in the positive and inverse directions at a fixed angle.

The main body case 2 of the aforementioned device comprises an ash receiving chamber 3 in which water is filled, a casing 5 which forms the inlet opening 4 installed above the chamber, a discharge chute 7 which forms an outlet opening 6 installed in the front part of the ash receaving chamber 3, and a lever case 8 attached to the rear part of the ash receaving chamber 3. The inlet opening 4 of the aforementioned casing 5 is apertured for communication with the discharge mouth (not illustrated) of the incinerator using a connecting flange 13 in the hermetically sealed state.

As shown in FIG. 2, the bottom of the ash receiving chamber 3 is formed to be gently curved so that a pusher 10 is able to slide smoothly forwards and backwards along the gently curved bottom as more fully explained later.

The main body case 2 of the aforementioned device is formed with thick steel plates. However, it is needless to say that the steel plates can be replaced with reinforced concrete.

The aforementioned main shaft 9 is installed horizontally in the rear of, and above the main body case 2, or below the lever case 8. Both ends of the main shaft 9 are protruded through the side walls of the ash receiving chamber 3 to be maintained so as to be able to rotate.

As illustrated in FIG. 3, levers 14 protruding backwards to the direction of the ash receiving chamber 3 an inverted U-shaped arm bodies 12*a* equipped with the pressing plates 12 at their tips are fixed on the main shaft 9.

The aforementioned pusher 10 is formed by bending steel plates, and a pusher liner 10*a* formed on the edge part of the pusher 10 to force out the incineration ash settled down on the bottom of the ash receiving chamber 3.

The pusher 10, the width of which is approximately equal to the width of the ash receiving chamber 3, and a sliding body 10*b*, which is made replaceable and fitted onto the lower part of the edge section of the pusher liner 10*a*, that is, the part which makes contact with the bottom of the ash receiving chamber 3, are designed to allow the pusher 10 to operate smoothly.

The upper end part of the pusher 10 is connected to the end part of the aforementioned lever 14 by means of a shaft 15 to allow a free rotation. Therefore, when the lever 14 moves upwards and downwards, the tip of the pusher 10 is drawn backwards or pushed forwards.

On the other hand, the aforementioned arm body 12*a* is formed in an inverted U-shape, and on the front edge part of which a pressing plate 12 is provided to force down matter floating on the water surface. The upper part of the pressing plate 12 is formed in a slope so that the incineration ash will not accumulate on it when the ash falls.

The base part of the arm body 12*a* is connected to a main shaft 9 so that the pressing plate 12 placed at the front edge part reaches the water surface W and is positioned beneath the inlet opening 4 of the main body case when the pusher 10 is in a retracted position. That is to say, the arm body 12*a* is designed to turn upwards when the pusher 10 moves forwards, and turn downwards when the pusher 10 moves backwards thus allowing the pressing plate 12 to touch the water surface W or to go slightly under the water surface W.

With the described embodiment herewith, it is so designed that when a pusher 10 moves forwards the pressing plates 12 turns upward, while the pusher 10 moves backwards the pressing plate 12 turns downwards. However, the embodiment is not limited to such an operation mechanism, and it could be so modified that when the pusher 10 move forwards, the pressing plate 12 turns downwards, while when the pusher 10 moves backwards the pressing plate 12 turns upwards.

A driving mechanism 11 to turn the main shaft 9 in the positive and inverse directions at a fixed angle is connected to the lever 16 fixed at both ends of the aforementioned main shaft 9.

That is, with the described embodiment herewith, a driving mechanism 11 comprises an oil hydraulic cylinder 11*a*, an oil hydraulic pump (not illustrated) and an oil hydraulic directional switching valve (not illustrated), etc. Expansion and contraction of the oil hydraulic cylinder 11*a* is operated by the oil hydraulic directional switching valve so that the main shaft 9 turns in the positive and inverse directions at a fixed angle by means of the lever 16. The oil hydraulic directional switching valve to expand and contract the oil hydraulic cylinder 11*a* is so controlled by a limit switch (not illustrated) installed in the vicinity of the lever 16 that the lever 16 touches the limit switch when the pusher 10 reaches either advanced or retracted positions, and thus the directional switching valve is switched over to make the oil hydraulic cylinder 11*a* automatically expand and contract.

With the described embodiment herewith, each end of the main shaft 9 is installed with a set of driving mechanism 11. However, the embodiment is not limited to such an embodiment, but it could be so modified that just one end of the main shaft 9 is installed with a set of driving mechanism 11.

Furthermore, 17, 18, 19 and 20 shown in FIGS. 1 and 2 are a frame to support the main body case 2, a drainage to remove the water in the ash receiving chamber 3, a lid for the purpose of inspection and a scraper to remove the adhered incineration ash respectively.

Next, the functions with the device to force out the incineration ash will be explained.

High temperature incineration ash discharged out of the incinerator falls into the water in the ash receiving chamber 3, and settles downwards while burning of the ash is extinguished. Even when unburnt properties exist, or matter such as metal cans found in the incineration ash remain floating on the water surface W, a pressing plate 12 forces down the floating matter, thus preventing the formation of the bridge of the incineration ash on the water surface in the ash receiving chamber 3.

Namely, a main shaft 9 turns in the direction of the arrow c by means of a lever 16 when the oil hydraulic cylinder 11*a* of a driving mechanism 11 expands, and a pressing plate 12 is lifted upwards by means of an arm body 12*a* when a pusher 10 moves forwards in the direction of the arrow d by means of a lever 14 from a retracted position (shown in the solid lines in FIG. 2). Thus, the incineration ash is forced out from the outlet opening 6.

When the pusher 10 reaches an advanced position (shown in the dot-and-dash lines), and a directional switching valve is switched over by the operation of the limit switch, the oil hydraulic cylinder 11*a* contracts. Along with the contraction of the oil hydraulic cylinder 11*a*, the main shaft 9 turns in the opposite direction to the arrow c, and the pusher 10 retracts in the opposite direction to the arrow d, while the arm body 12*a* swings downwards and the pressing plate 12 forces down the floating matter on the water surface into the water. Then, when the pusher 10 reaches the retracted position, and a directional switching valve is again switched over by the operation of the limit switch, the oil hydraulic cylinder 11*a* expands. The above mentioned actions are thus repeated.

With the described embodiment herewith, an oil hydraulic cylinder 11*a* is employed as a driving mechanism 11. However, the embodiment is not limited to such a driving mechanism, and it could be so modified that a gear driving mechanism can be employed, as an alternative embodiment, to turn the main shaft 9 in the positive and inverse directions.

Furthermore, with the described embodiment herewith, two arm bodies 12*a* are employed at two places. However, the embodiment is not limited to such a number, and it could be so modified that the arm body 12*a* can be employed at one place or multiple places.

What is claimed is:

1. A device to force out the incineration ash comprising a main body case provided with an ash receiving chamber in which water is filled, an inlet opening for the incineration ash discharged out of a refuse incinerator and an outlet opening for the incineration ash after burning is extinguished; a main shaft installed horizontally in the rear part of the inlet opening of the main body case and supported so as to be able to turn; a driving mechanism to make the aforementioned main shaft turn in the positive and inverse directions at a fixed angle; a pusher installed on the aforementioned main shaft by means of a lever to force out the incineration ash settled on the bottom of the ash receiving chamber; and a pressing plate installed on the aforementioned main shaft by means of an arm to force down the matter floating on the water surface in the ash receiving chamber into the water.

2. A device to force out the incineration ash as claimed in claim 1, wherein a pusher is moved forwards and a pressing plate is elevated by the turning of the main shaft in one direction, while the pusher is moved backwards and the pressing plate is descended by the turning of the main shaft in the other direction.

3. A device to force out the incineration ash as claimed in claim 1 or 2, wherein the bottom of the main body case is formed to be gently curved.

4. A device to force out the incineration ash as claimed in claim 1 or 2, wherein the main body case is formed with steel plates or reinforced concrete.

5. A device to force out the incineration ash as claimed in claim 1 or 2, wherein the driving mechanism is formed by an oil hydraulic cylinder.

6. A device to force out the incineration ash as claimed in claim 1 or 2, wherein the width of the pusher is approximately equal to that of the ash receiving chamber and a sliding body which is made replaceable, is attached to the part which makes contact with the bottom of the ash receiving chamber.

7. A device to force out the incineration ash as claimed in claim 1 or 2, wherein more than two pressing bodies are employed and their upper surface is formed in a slide shape.

8. A device to force out the incineration ash as claimed in claim 1 or 2, wherein the pressing body descends to the position where it touches the water surface or slightly goes into the water.

* * * * *